US008495773B2

(12) United States Patent
Liversage et al.

(10) Patent No.: US 8,495,773 B2
(45) Date of Patent: Jul. 30, 2013

(54) BED SHEET

(76) Inventors: Thomas Liversage, Frederick, MD (US); Monica Ditzler, Lewisville, TX (US)

( * ) Notice: Subject to any disclaimer, the term of this patent is extended or adjusted under 35 U.S.C. 154(b) by 0 days.

(21) Appl. No.: 13/162,383

(22) Filed: Jun. 16, 2011

(65) Prior Publication Data

US 2012/0317723 A1 Dec. 20, 2012

(51) Int. Cl.
*A47G 9/02* (2006.01)
*A47G 9/04* (2006.01)

(52) U.S. Cl.
USPC ..... 5/497; 5/496; 5/499

(58) Field of Classification Search
USPC ..... 5/497, 496, 499, 495, 482, 737
See application file for complete search history.

(56) References Cited

U.S. PATENT DOCUMENTS

| | | | | | |
|---|---|---|---|---|---|
| 738,674 | A * | 9/1903 | Grattan | 5/496 |
| 1,267,593 | A * | 5/1918 | Roever | 5/499 |
| 1,359,526 | A * | 11/1920 | Ray | 5/499 |
| 1,865,329 | A * | 6/1932 | McHorter | 5/497 |
| 2,151,375 | A * | 3/1939 | De Voe | 5/497 |
| 2,462,156 | A * | 2/1949 | Berman | 5/496 |
| 2,499,698 | A * | 3/1950 | Thomas | 5/499 |
| 2,630,588 | A * | 3/1953 | Levin | 5/496 |
| 2,682,062 | A * | 6/1954 | Cogan | 5/496 |
| 2,727,253 | A * | 12/1955 | Tomsic | 5/496 |
| 2,757,389 | A * | 8/1956 | King | 5/496 |
| 2,972,756 | A * | 2/1961 | Monier et al. | 5/496 |
| 3,083,379 | A * | 4/1963 | Marinsky | 5/496 |
| 3,243,827 | A * | 4/1966 | Kintner | 5/496 |
| 3,900,909 | A * | 8/1975 | Monier et al. | 5/496 |
| 4,045,832 | A * | 9/1977 | DiForti et al. | 5/496 |
| 4,144,602 | A * | 3/1979 | Fernandes | 5/496 |
| 4,245,365 | A * | 1/1981 | Large | 5/496 |
| 4,301,561 | A * | 11/1981 | McLeod | 5/496 |
| 4,344,196 | A * | 8/1982 | Large | 5/496 |
| 4,494,262 | A * | 1/1985 | Robertson | 5/669 |
| 4,651,371 | A * | 3/1987 | Hahn | 5/497 |
| 4,703,529 | A * | 11/1987 | Mann | 5/494 |
| 5,233,714 | A * | 8/1993 | De Bell Daniel | 5/655 |
| 6,389,621 | B1 * | 5/2002 | Elliott et al. | 5/497 |
| 6,892,404 | B2 * | 5/2005 | Harbin et al. | 5/497 |
| 8,015,636 | B2 * | 9/2011 | Bolish et al. | 5/496 |
| 2004/0200000 | A1 * | 10/2004 | Harbin et al. | 5/497 |
| 2012/0317723 | A1 * | 12/2012 | Liversage et al. | 5/497 |

* cited by examiner

*Primary Examiner* — Robert G Santos
(74) *Attorney, Agent, or Firm* — Oliff & Berridge, PLC

(57) ABSTRACT

A bed sheet to cover a mattress may include a top sheet to cooperate with the substantially the top surface of the mattress, and a connector sheet to cooperate with the top sheet to stabilize the top sheet with respect to the mattress. The connector sheet and the top sheet may define an aperture to cooperation with a bottom corner of the mattress. The aperture may be substantially a rectangle, and the connector sheet may be substantially T-shaped. The connector sheet may be an inverted T-shaped sheet, and the connector sheet may include a base portion to connect the bottom edge of the top sheet. The connector sheet may include a top portion to connect to a side edge of the top sheet.

13 Claims, 3 Drawing Sheets

BED SHEET

FIELD OF THE INVENTION

The present invention relates to a bed sheet and a connector sheet and more particularly to a bed sheet and the connector sheet having apertures to cooperate with the corners of the mattress in order to stabilize and secure the bed sheet on the mattress. This art also addresses securing the top sheet, fitted bottom sheet and any other sheets fitted to the mattress in a fashion that allows the bed to the easily made due to sheets coming loose or becoming untucked.

BACKGROUND

Conventional bed sheets, blankets, quilts, comforters and bedspreads are created as a flat cloth that is draped over the mattress and tucked in if desired. These bed coverings are manufactured in a multitude of sizes to accommodate the various mattress sizes, such as twin, full, queen, king, "California King", mattress depths, including standard and "pillow top", and various mattress types, such as those used in beds at home, or those used in hotels, hospitals, barracks, and other commercial or governmental settings requiring beds. Custom bed coverings size can also exist, such as, for example those customized to fit specialized mattresses such as mattresses utilized in trucks, campers, recreational vehicles, sofa beds, children's beds, cribs, bassinets, irregularly-shaped mattresses or the like. Although many mattress sizes are standardized, the precise dimensions of a standardized mattress may vary slightly from manufacturer to manufacturer.

The changing of bed coverings is often regarded as a "chore" by those desiring to, e.g., change the bed sheets or blankets on their beds at home, or by those employed to change bed linens, such as, in hotels and hospitals. As such, improvements are sought to make life easier when it comes to changing a bed. At home this can translate to more time for other activities, and in a commercial setting, can translate to the saving of time and money spent in servicing the bed linens.

It has also been stated previously that after making a bed in the usual manner certain difficulties are encountered. The most annoying difficulty is that often the bottom portion of the bed sheet or blanket will be kicked loose from the mattress by a restless sleeper at a time that is not conducive to remaking the bed, thereby causing chill and discomfort to the sleeper(s).

A great deal of time is expended by an individual who must remake the entire bed due to the loosening of the top sheet only. As the bed sheet or blanket is kicked free, so too are the bed coverlets above or below it loosened. Depending upon the number of coverlets above or below the sheet or blanket, it will take a minimum of ten minutes per day to remake an entire queen-sized bed. That means one (1) hour and ten (10) minutes per week, or sixty-one (61) hours per year to make just one bed. For a family of four members, daily bed making could take as much time as two hundred forty four (244) hours per year. In settings other than the home, such as a hotel, the collective time to make such beds, or change such beds can be significant.

The most common bed sheet or blanket configuration in use on beds today is the use of a fitted sheet to cover the mattress, with a flat sheet used as an upper sheet with a coverlet. Fitted sheets usually have an elastic strip at each corner or a single continuous strip surrounding the open edge of the sheet.

Typically, a bed sheet or blanket is placed over a top or flat sheet and the fitted bottom sheet. The bed sheet or blanket may be tucked beneath the foot end of the mattress when the bed is made. However, the bed sheet or blanket as well as the top sheet and the fitted sheets frequently become loose from under the mattress during use and are inconvenient to tuck in and refold when the bed is again made. Known to the art are bed clothes, made for use with waterbeds, which include a top sheet having a portion of the lower edge attached to the lower end of the fitted sheet. This method of attaching the top sheet to the fitted sheet illuminates many of the problems associated with loose top sheets. However, it fails to address the inconvenience of refolding the top sheet at the lower corner to provide a finished appearance should the waterbed be utilized with a conventional mattress. Furthermore, it fails to address the inconvenience of tucking the top bed sheet or blanket loosened during sleep.

Fitted bottom sheets are known including an overhang which overhangs the sides of a mattress and is drawn inwardly under the mattress by elastic strips so that the bottom sheet is tightly spread over the top of the mattress and held securely in place. When a separate flat top sheet is used with the fitted bottom sheet, it must be carefully adjusted and tucked in with hospital corners, and even then the bed sheet or blanket comes untucked readily. This makes making up the bed an unnecessarily complicated procedure for everyone, and a potentially difficult procedure for those with vision problems or other physical difficulties.

Fitted top sheets are also known having the same type of fitting at the bottom as the fitted bottom sheets, particularly with satin sheets, but this construction leaves little room at the bottom for the sleeper's feet.

It is even known to have a combination of a fitted bottom sheet with an attached top sheet. However, the known constructions for such combinations either provide too little space for the sleeper's feet and/or require complicated constructions that are relatively expensive and difficult to handle when making up the bed.

U.S. Pat. No. 5,884,349 discloses a bed sheet combination including a bottom sheet having a foot end, a top sheet having a foot end, and a connector band of stretchable fabric secured between the bottom sheet and the top sheet to attach the foot end of the top sheet to the foot end of the bottom sheet. The connector band has a first edge attached to the foot end of the bottom sheet and has a second edge attached to the foot end of the top sheet. The connector band enables the foot end of the top sheet to be pulled away from the foot end of the bottom sheet while being urged to return in the direction of the foot end of the bottom sheet.

U.S. Pat. No. 7,380,297 discloses a bed coverings for a mattress and, more particularly, a fitted (or semi-fitted) top sheet that may be attached at one end to the mattress and which may be placed between a user and other bedding such as blankets, quilts, comforters, or the like. The fitted sheet provides for ease in changing or making the bed. The fitted bed sheet of the present invention includes a zone of expansion to provide extra room for a sleeper's feet, and provides overhanging side flaps to provide and end-to-end finished look. Additionally, the present invention is directed to a fitted blanket, fitted quilt, fitted comforter and fitted bedspread for a mattress. The invention is also directed to a pattern for making these fitted bed coverings from an existing flat sheet or a starting flat cloth.

U.S. Pat. No. 7,411,288 discloses a fitted blanket having a generally rectangular pocket member attached at its foot end to fit over the foot of the bed mattress. The pocket member is formed of a fabric, e.g., flannel, and has top, side, bottom and back panels, with the top panel having a length dimension of about twelve to twenty-four inches. The side panels have forward edges that extend diagonally from the bottom panel to the top panel Elastic extends around the pocket member is joined to the blanket portion at a seam sewn across the front edge of the top panel. The deep pocket member of this design accommodates in comfort the feet of a sleeper in the bed and also resists being pulled or kicked off the bed.

SUMMARY

A bed sheet to cover a mattress may include a top sheet to cooperate with the substantially the top surface of the mattress, and a connector sheet to cooperate with the top sheet who stabilize and secure the top sheet with respect to the mattress;

The connector sheet and the top sheet may define an aperture to cooperate with a bottom corner of the mattress.

The aperture may be substantially a rectangle, and the connector sheet may be substantially T-shaped.

The connector sheet may be an inverted T-shaped sheet, and the connector sheet may include a base portion to connect to the bottom edge of the top sheet.

The connector sheet may include a top portion to connect to a side edge of the top sheet.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The present invention may include a bed sheet 100 which may be used as a bottom sheet, a top sheet, a blanket, quilts or other like device. The teachings of the present invention are applicable to any sheet including a bed sheet of flexible material. Furthermore, the bed sheet 100 may not be limited to use with a mattress, but may be used with other types of objects such as pillows, pads for chairs, pads for sofas or other similar types of objects.

Figure 1:
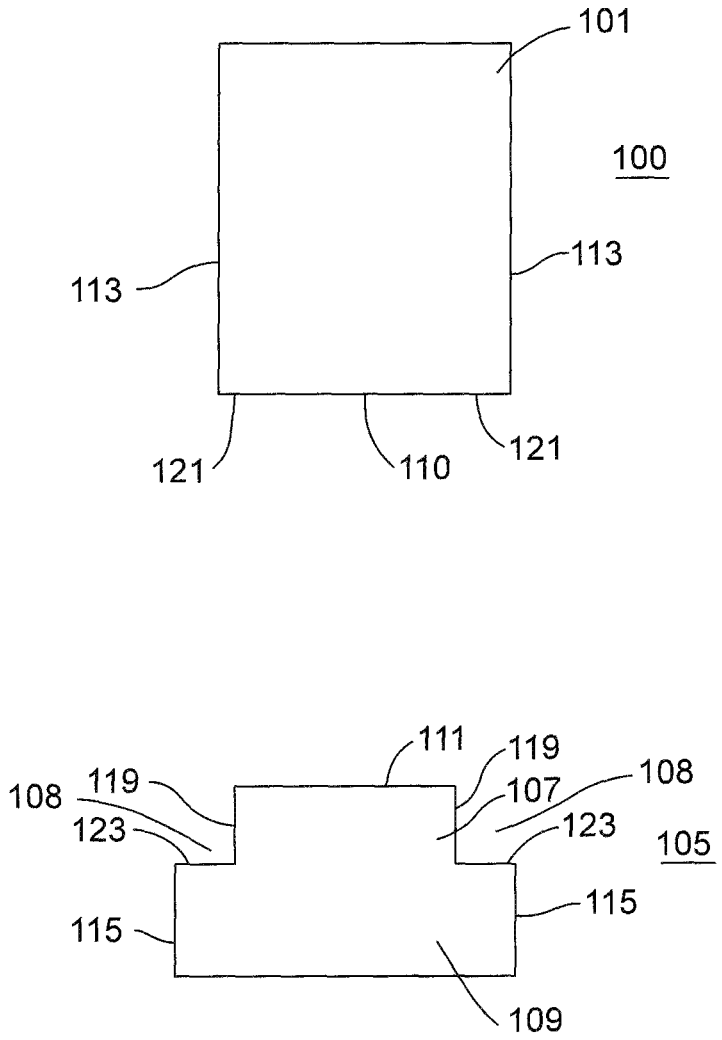
FIG. 1 illustrates an exploded view of the top sheet and the connector sheet of the bed sheet of the present invention.

The bed sheet 100 as illustrated in FIG. 1 may include a top sheet 101 which may be substantially rectangular and may conform to approximately the top surface area of the mattress. The top sheet 101 may be a single sheet of fabric, may be a woven sheet of fabric, a quilted sheet of fabric or other such sheet. The bed sheet 100 may include a connector sheet 105 to connect and stabilize the top sheet 101 on a mattress which may be an inverted T-shaped sheet which may be flexible and formed from stretchable fabric. The connector sheet 105 may include a base portion 107 and a top portion 109. The bottom edge 111 of the base portion 107 may be connected to a substantially a center edge 110 of the bottom of the top sheet 101 and the side edges 115 of the top portion 109 may be connected to a side edge 113 of the top sheet 101. The above connection of the connector sheet 105 and a top sheet 101 forms a pair of opposing apertures 108 which may be defined by the side edge 119 of the base portion 107, the outer edge 121 of the top sheet 101, the side edge 113 of the top sheet 101 and the bottom edge 123 of the top portion 109. The connector sheet 105 may include a Velcro (hooks and loops) zipper, sewn on or other fastener devices. The opposing apertures 108 may be substantially rectangular, oval, circular or other shape to cooperate with the bottom corners of the mattress in order to hold the top sheet 101 substantially in position over the top surface of the mattress.

Figure 2:
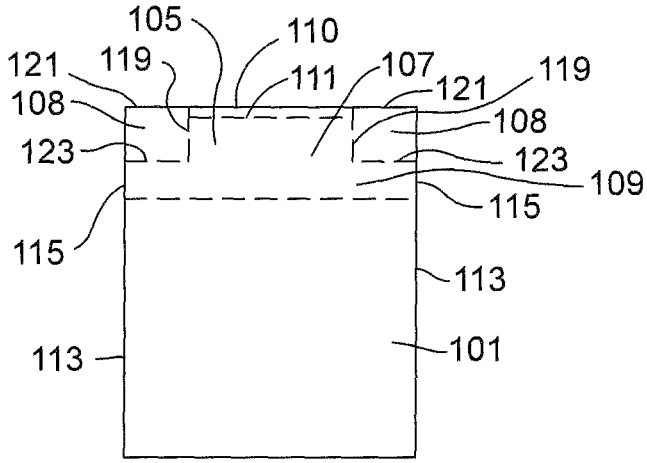
FIG. 2 illustrates a top view of the top sheet and the connector sheet of the bed sheet of the present invention.

FIG. 2 illustrates a top view of the bed sheet 100 which may include a top sheet 101 which may be substantially rectangular and may conform to approximately the top surface area of the mattress. The top sheet 101 may be a single sheet of fabric, may be a woven sheet of fabric, a quilted sheet of fabric or other such sheet. The bed sheet 100 may include a connector sheet 105 to connect and stabilize the top sheet 101 on a mattress which may be an inverted T-shaped sheet which may be flexible and formed from stretchable fabric. The connector sheet 105 may include a base portion 107 and a top portion 109. The bottom edge 111 of the base portion 107 may be connected to a substantially a center edge 110 of the bottom of the top sheet 101 and the side edges 115 of the top portion 109 may be connected to a side edge 113 of the top sheet 101. The above connection of the connector sheet 105 and a top sheet 101 forms a pair of opposing apertures 108 which may be defined by the side edge 119 of the base portion 107, the outer edge 121 of the top sheet 101, the side edge 113 of the top sheet 101 and the bottom edge 123 of the top portion 109. The opposing apertures 108 may be substantially rectangular, oval, circular or other shape to cooperate with the bottom corners of the mattress in order to hold the top sheet 101 substantially in position over the top surface of the mattress.

Figure 3:
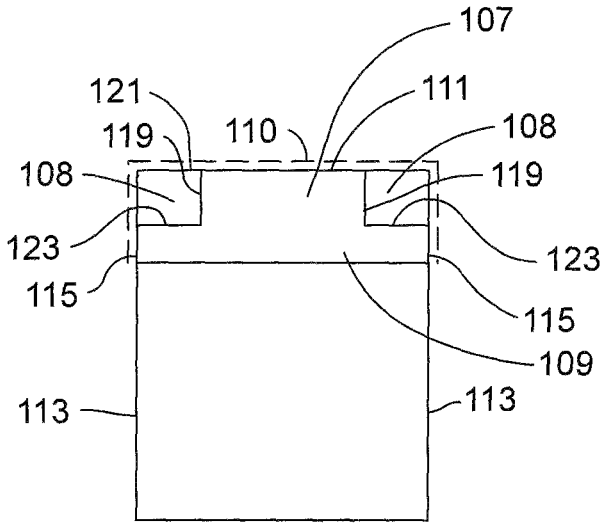
FIG. 3 illustrates a bottom view of the connector sheet and a top sheet of the bed sheet of the present invention.

FIG. 3 illustrates a bottom view of the bed sheet 100 which may include a top sheet 101 which may be substantially rectangular and may conform to approximately the top surface area of the mattress. The top sheet 101 may be a single sheet of fabric, may be a woven sheet of fabric, a quilted sheet of fabric or other such sheet. The bed sheet 100 may include a connector sheet 105 to connect and stabilize the top sheet 101 on a mattress which may be an inverted T-shaped sheet which may be flexible and formed from stretchable fabric. The connector sheet 105 may include a base portion 107 and a top portion 109. The bottom edge 111 of the base portion 107 may be connected to a substantially a center edge 110 of the bottom of the top sheet 101 and the side edges 115 of the top portion 109 may be connected to a side edge 113 of the top sheet 101. The above connection of the connector sheet 105 and a top sheet 101 forms a pair of opposing apertures 108 which may be defined by the side edge 119 of the base portion 107, the outer edge 121 of the top sheet 101, the side edge 113 of the top sheet 101 and the bottom edge 123 of the top portion 109. The opposing apertures 108 may be substantially rectangular, oval, circular or other shape to cooperate with the bottom corners of the mattress in order to hold the top sheet 101 substantially in position over the top surface of the mattress.

Figure 4:
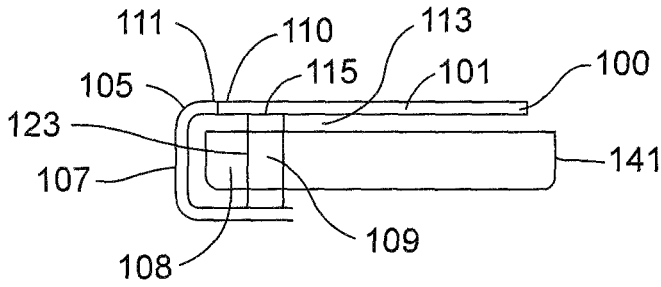
FIG. 4 illustrates a side view of the connector sheet and the top sheet of the bed sheet of the present invention.

FIG. 4 illustrates a side view of the bed sheet 100 and mattress 141 which may include a top sheet 101 which may be substantially rectangular and may conform to approximately the top surface area of the mattress 141. The top sheet 101 may be a single sheet of fabric, may be a woven sheet of fabric, a quilted sheet of fabric or other such sheet. The bed sheet 100 may include a connector sheet 105 to connect and stabilize the top sheet 101 on a mattress which may be an inverted T-shaped sheet which may be flexible and formed from stretchable fabric. The connector sheet 105 may include a base portion 107 and a top portion 109. The bottom edge 111 of the base portion 107 may be connected to a substantially a center edge 110 of the bottom of the top sheet 101 and the side edges 115 of the top portion 109 may be connected to a side edge 113 of the top sheet 101. The above connection of the connector sheet 105 and a top sheet 101 forms a pair of opposing apertures 108 which may be defined by the side edge 119 of the base portion 107, the outer edge 121 of the top sheet 101, the side edge 113 of the top sheet 101 and the bottom edge 123 of the top portion 109. The opposing apertures 108 may be substantially rectangular, oval, circular or other shape to cooperate with the bottom corners of the mattress in order to hold the top sheet 101 substantially in position over the top surface of the mattress.

Figure 5:
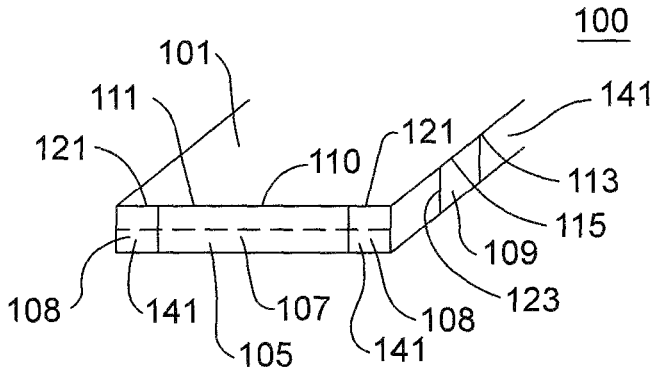
FIG. 5 illustrates a perspective view of the connector sheet and the top sheet of the bed sheet of the present invention.

FIG. 5 illustrates a perspective view of the bed sheet 100 which may include a top sheet 101 which may be substantially rectangular and may conform to approximately the top surface area of the mattress 141. The top sheet 101 may be a single sheet of fabric, may be a woven sheet of fabric, a quilted sheet of fabric or other such sheet. The bed sheet 100 may include a connector sheet 105 to connect and stabilize the top sheet 101 on a mattress which may be an inverted T-shaped sheet which may be flexible and formed from stretchable fabric. The connector sheet 105 may include a base portion 107 and a top portion 109. The bottom edge 111 of the base portion 107 may be connected to a substantially a center edge 110 of the bottom of the top sheet 101 and the side edges 115 of the top portion 109 may be connected to a side edge 113 of the top sheet 101. The above connection of the connector sheet 105 and a top sheet 101 forms a pair of opposing apertures 108 which may be defined by the side edge 119 of the base portion 107, the outer edge 121 of the top sheet 101, the side edge 113 of the top sheet 101 and the bottom edge 123 of the top portion 109. The opposing apertures 108 may be substantially rectangular, oval, circular or other shape to cooperate with the bottom corners of the mattress in order to hold the top sheet 101 substantially in position over the top surface of the mattress.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A bed sheet comprising:

a top sheet that includes:

a top edge and a bottom edge opposite the top edge, and a first side edge and a second side edge opposite the first side edge, wherein the first side edge and the second side edge are between the top edge and the bottom edge; and a connector sheet that includes:

a base portion attached to the top sheet via the bottom edge of the top sheet, and a top portion attached to the top sheet via both the first side edge and the second side edge, wherein:

the top sheet and the connector sheet form a pair of opposing apertures, and each aperture is defined by both the bottom edge and one of the side edges of the top sheet and by both the base portion and the top portion of the connector sheet.

2. The bed sheet according to claim 1, wherein the base portion and the top portion together form a one-piece unitary structure.

3. The bed sheet according to claim 2, wherein the base portion and the top portion together form an inverted T-shape.

4. The bed sheet according to claim 1, wherein the top portion extends below the top sheet between the first side edge and the second side edge and is attached to the top sheet via both the first side edge and the second side edge.

5. The bed sheet according to claim 1, wherein when the bed sheet is attached to a mattress:

the base portion includes a vertical portion that extends downward from the bottom edge of the top sheet and a horizontal portion that extends from the vertical portion toward the top edge of the top sheet, and the top portion extends between the first side edge and the second side edge and is attached to the top sheet via both the first side edge and the second side edge and to the horizontal portion of the base portion via an end opposite the vertical portion.

6. The bed sheet according to claim 1, wherein:

the top sheet is a rectangular sheet, and both the first side edge and the second side edge are longer than the top edge and the bottom edge.

7. The bed sheet according to claim 6, wherein the base portion and the top portion form an inverted T-shape.

8. The bed sheet according to claim 6, wherein when the bed sheet is attached to a mattress:

the base portion includes a vertical portion that extends downward from the bottom edge of the top sheet and a horizontal portion that extends from the vertical portion toward the top edge of the top sheet, and the top portion extends between the first side edge and the second side edge and is attached to the top sheet via both the first side edge and the second side edge and to the horizontal portion of the base portion via an end opposite the vertical portion.

9. The bed sheet according to claim 1, wherein the top sheet and the connector sheet are separate sheets.

10. The bed sheet according to claim 1, wherein the base portion and both side edges of the top portion each have a fastener.

11. A bed sheet comprising:

a top sheet; and a connector sheet that has an inverted T-shape, wherein:

the top sheet is connected to the connector sheet, the top sheet and the connector sheet are separate sheets, wherein:

the top sheet and the connector sheet form a pair of opposing apertures, and each aperture is defined by both a bottom edge and a side edge of the top sheet and by at least two sides of the connector sheet.

12. The bed sheet according to claim 11, wherein the top sheet and the connector sheet are made of separate materials.

13. The bed sheet according to claim 11, wherein a bottom edge and both side edges of the connector sheet each have a fastener.

* * * * *